US006059697A

United States Patent [19]

Breems

[11] Patent Number: 6,059,697

[45] **Date of Patent: *May 9, 2000**

[54] EXERCISE APPARATUS FOR RUNNING OR WALKING AND METHOD OF MANUFACTURE

[76] Inventor: Martinus Van Breems, 9 Violets La., Westport, Conn. 06880

[ * ] Notice: This patent is subject to a terminal disclaimer.

[21] Appl. No.: 09/033,404

[22] Filed: Mar. 2, 1998

Related U.S. Application Data

[63] Continuation-in-part of application No. 08/745,087, Nov. 7, 1996, Pat. No. 5,755,644.

[51] Int. Cl.[7] ..... A47D 13/04; A61H 3/02

[52] U.S. Cl. ..... 482/67; 482/74; 135/68

[58] Field of Search ..... 482/66, 67, 69, 482/116, 120, 74; 135/68, 66, 71, 73, 74; 623/31; 16/257, 266, 342; 403/361, 165, 348, 349; 280/618

[56] References Cited

U.S. PATENT DOCUMENTS

| | | | |
|---|---|---|---|
| 127,425 | 6/1872 | Norton . | |
| 1,402,129 | 1/1922 | Piscitelli | 482/124 |
| 2,097,376 | 10/1937 | Marshman | 482/124 |
| 2,573,866 | 11/1951 | Murphy | 623/31 X |
| 3,853,414 | 12/1974 | Hirano . | |
| 4,245,659 | 1/1981 | Shofner | 135/68 |
| 4,961,573 | 10/1990 | Wehrell | 482/74 |
| 5,348,035 | 9/1994 | Porter | 135/68 X |
| 5,755,644 | 5/1998 | Breems | 482/67 |
| 5,792,034 | 8/1998 | Kozlovsky | 482/74 X |
| 5,820,533 | 10/1998 | Goldman | 482/74 X |

*Primary Examiner*—Richard J. Apley
*Assistant Examiner*—William La Marca

[57] ABSTRACT

An improved exercise device including two exercise poles, each having an upper segment secured via an articulating joint to the upper body and a lower segment which is slidably connected to the upper segment. The lower segment includes a hand support or hand grip. A vest with an integral harness includes left and right side articulating joints providing a selected amount of friction. Preferably, each joint includes a cylindrical molded hub with two opposed transversely projecting bayonet lugs; the hub is received within a collar affixed at the proximal end of an upper pole segment and having a circular aperture ringed by an inwardly projecting annular flange with two opposed grooves adapted to receive the two hub bayonet lugs. The hub and collar are separable and are joined by aligning the hub bayonet lugs with the collar flange grooves whereupon the hub may be inserted coaxially within the collar, thereby projecting the hub lugs beyond the opposing surface of the inwardly projecting annular flange. The collar (and attached upper segment may then be rotated around the axis of the hub to rotatably secure the collar onto the hub. The upper segment is slidably and rotatably connected to the lower segment allowing the lower segment to be twisted and moved rectilinearly relative to the upper segment. The lower segment is terminated at the bottom in an elastomeric pole tip for absorbing shock.

4 Claims, 10 Drawing Sheets

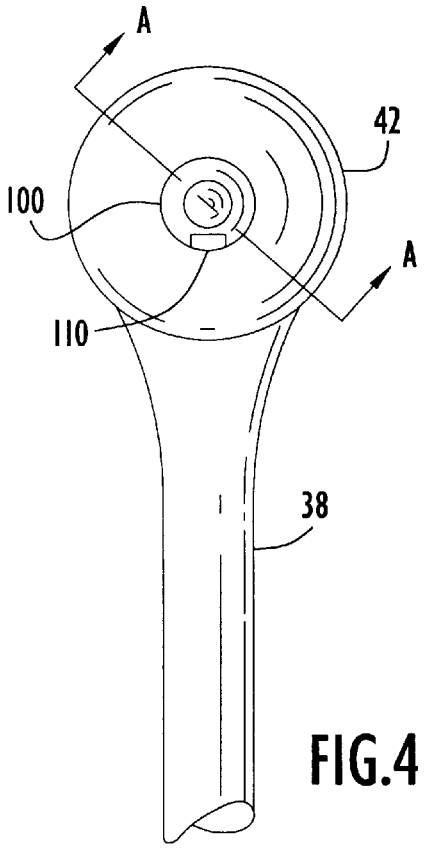
FIG.4
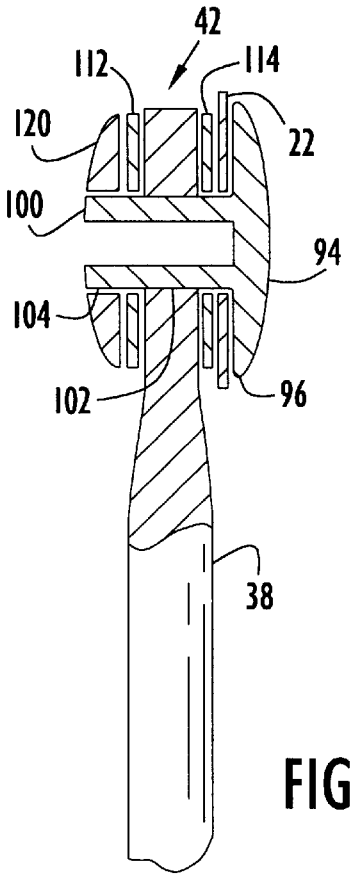
FIG.5
FIG.6A
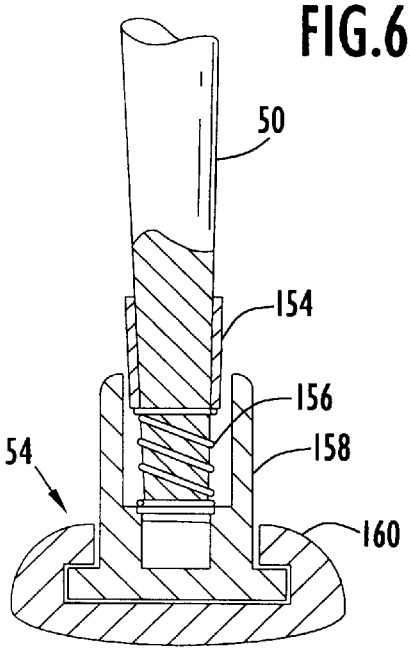
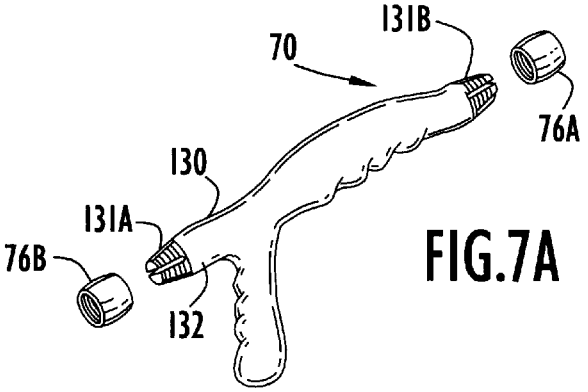
FIG.7A

EXERCISE APPARATUS FOR RUNNING OR WALKING AND METHOD OF MANUFACTURE

This application is a continuation-in-part application of application Ser. No. 08/745,087, filed Nov. 7, 1996, now U.S. Pat. No. 5,755,644.

BACKGROUND OF THE INVENTION

1. Field of the Invention

The present invention relates to an improved exercise apparatus for use while running or walking. More particularly, the present invention is directed a method for exercising and an improved apparatus for practicing the method including exercise poles to be grasped by a user's hands for exerting downward force with the arms and upper body during running or walking.

2. Discussion of the Related Art

Running and walking are popular forms of exercise, but are not suitable for everyone. Many people have difficulty in running because a significant amount of strain is placed on the feet, ankles, knees, hips and back due to jolting forces transmitted through the foot from impact with the ground. People with disabilities also have difficulty in exercising by running or walking and often cannot get a vigorous workout without risking injury from loss of balance. Another difficulty is that running for exercise provides very little work for the upper body.

A number of other forms of exercise have been developed which have proven only partly satisfactory in dealing with such difficulties. Cross-country skiing utilizes poles to provide balance and locomotive force, in turn providing some upper body exercise; however, the poles are primarily useful in a low-friction environment, such as on snow, where only moderate force is used for forward propulsion. Ski poles and similar devices, such as are disclosed in U.S. Pat. No. 4,756,524, are held out in front of the body, making it difficult to provide much downward force in performing an exercise; the body's weight is not borne by the arms, therefore, such devices are not very useful in reducing the strain and jolting forces which the legs and lower body experience while running, and the risk of strained ankles or twisting injuries is not sufficiently reduced.

In the medical arts (as contrasted with the exercise equipment arts), a number of crutches have been disclosed. These are not for use in exercise but are for use by those patients which have difficulty in walking. Crutches, as such, fall into two general categories, underarm crutches and forearm crutches. In general, underarm crutches are intended to support the patient's weight on an upper arm rest at the underarm; a hand grip is used primarily to move the crutch. Forearm crutches include a hand hold for bearing the patient's weight and a forearm brace, to allow the patient to align his or her forearm with the crutch.

Forearm crutches, such as are disclosed in U.S. Pat. No. 5,193,567, present two problems. First, forearm crutches typically permit only some of the patient's weight to be on the hands and are loosely braced to the forearm (see loop 22) to align the forearm with the crutch hand rest. Second, the restricted movement imposed by the arm brace makes it awkward to control the position of the crutch, since the crutch must be moved in a fore and aft motion while held by the hand grip.

Neither type of crutch is conducive to a natural and vigorous motion for use in a walking or running exercise. It is not possible to keep the top padded portion of an underarm crutch braced in a user's underarm while extending the hand and arm in a motion which places the user's weight on the hands, thus providing some form of upper body workout. Analogously, it is not possible to align, move and control the position a forearm crutch in a natural and vigorous walking or running exercise, while placing a significant amount of downward force on the forearm crutch handle. For these reasons, crutches have not been adopted as exercise devices.

Accordingly, there is a need for an exercise device with which a user may obtain vigorous exercise while avoiding the strain and jolting forces typically resulting from running.

OBJECTS AND SUMMARY OF THE INVENTION

A primary object of this invention is to efficiently manufacture an improved apparatus for exercise which permits a smooth and well-controlled movement of two exercise poles; in the exercise, a user momentarily bears some weight on the hands, thereby relieving strain on the legs, ankles and feet.

A further object of the present invention is to provide readily articulable exercise poles with rotatable hand holds slidably extendable along the length of the poles and having an improved hinge or joint, thereby permitting a fluid exercise motion.

Another object of the present invention is to efficiently manufacture exercise poles with a vest and harness fastenable to the body to control the position of the exercise poles.

In accordance with the present invention, a new exercise apparatus is disclosed including a vest with an integral harness for attachment about the wearer's upper chest and left and right exercise poles with horizontal hand holds. Each pole's upper segment is secured to the harness via an improved hinge or articulating joint; a lower segment is slidably, coaxially connected to the upper segment; the hand hold is affixed to the lower segment.

Since the upper segment is slidably, telescopically held within the lower segment, the user may rotate the horizontal hand hold about the common axis of the lower and upper segments and may, by extending the elbow, move the lower segment distally away from the user's body. Hand rotation permits a natural and fluid motion while still allowing the user to place significant downward force on the handholds.

The upper segment can be freely moved approximately sixty degrees in a front to back arc. The improved, selectively detachable, joint or hinge provides a selected amount of friction, thereby providing additional resistance and more strenuous exercise. Preferably, a mechanical joint with a cylindrical molded hub includes, two opposed transversely projecting salients or bayonet lugs; the joint hub can be received within a collar affixed at the proximal end of the upper segment. The collar has a circular aperture therethrough, the aperture is ringed by an inwardly projecting annular flange with two opposed grooves adapted to receive the two hub bayonet lugs. The hub and collar are separable and are joined by aligning the hub bayonet lugs with the collar flange grooves whereupon the hub may be inserted coaxially within the collar, thereby projecting the hub lugs beyond the opposing surface of the inwardly projecting annular flange. The collar (and attached upper segment may then be rotated around the axis of the hub to rotatably secure the collar onto the hub. Selected amounts of static friction and sliding friction between the each lugs inner surface and the flange opposing surface controls the effort required in exercising while swinging the exercise poles fore and aft.

Preferably, the lower segment includes a vertical hand grip on the upper part of the lower segment, allowing the lower segment of the device to be used like a ski pole by disconnecting the lower segment from the upper segment. As noted above, the lower segment also includes a lower horizontal hand hold, for use when the upper and lower segments are connected. The horizontal hand hold may be hollow and include a removable end cap, allowing weights or canisters of a chemical defensive spray (such as mace or pepper spray) to be inserted and retained inside the hand hold. The provision for defensive spray also includes a trigger device and means for directing the spray toward a point of aim. The horizontal hand hold and vertical hand grip are integrally molded and separated by about ten to twelve inches along a molded grip member, which is normally molded in two halves. Threads are molded in the top and bottom ends of the grip member. Top and bottom threaded rings or collet nuts engage the grip member threads, holding the two halves together. The top and bottom grip member threads are tapered and slit in two or more planes and are arranged to be drawn into the top and bottom nuts, thereby functioning as a collet. The grip member is slidable and telescopically adjustable over a tubular lower pole segment to adjust the position of the hand hold for the user. The grip member is preferably covered with a foam.

At the bottom of the lower segment, an elastomeric tip is preferably fitted to absorb shock. A spring may also be incorporated, to better absorb shock.

The exercise poles also incorporate a means of attaching the upper segment and hinge to the body which, in a preferred embodiment, is a vest including an integral elastic webbing harness with a horizontal strap running underneath the armpits, around the back and affixed in a stitched connection in the molded hub bases; the hub and resilient, flexible, substantially planar integral hub base are preferably molded in a one-piece structure. The vest is fastened over the chest (and preferably covers the abdomen) with a heavy duty (e.g., number 5 or heavier) zipper and includes first and second vertical shoulder straps running over the shoulders and down the back to the horizontal strap.

The vest and integral harness are efficiently manufactured by first molding a one-piece hub with a substantially planar base including a thicker central platform portion surrounded by a thinner flange adapted to be sewn through. The integral hub/base assembly is positioned on a vest fabric wall, optionally with a harness webbing or reinforcing patch on the opposing side of the vest fabric wall, and the base/vest/harness laminated structure is sewn through in making a stitched connection.

In use, the user attaches the upper pole segments to the hubs, dons and closes (e.g., zips) the vest and grasps the horizontal hand holds on each pole. As the user begins running or walking, a first pole lower segment is swung forward and extended down to plant the first pole and engage the ground. Force is then applied downwardly via the hand, arm and upper body muscles to allow the user to exercise these muscles and lessen the shock and load on the legs. The user then strides past the planted first pole. Once the user has stridden past the planted first pole, the lower segment is lifted in a rectilinear contraction along the upper segment axis by contracting the elbow and the pole is arcuately swung forward whereupon the cycle is repeated. The second pole is planted while the first pole is being swung forward; the second pole and first pole are planted and moved in an alternating cycle, as are the feet during running or walking. Since the distance between the articulating joint and the hand grip is roughly half the distance between the hand grip and the pole tip, the pole tip can be very quickly moved forward, as is needed when running.

The present invention allows significantly more downward force to be applied than with cross-country ski poles or other exercise poles of the prior art. More force on the hands yields greatly reduced force and shock loads on the legs and lower body while running. Since the weight of the entire body can be momentarily borne by an exercise pole hand hold, the risk of strained ankles and other twisting injuries is greatly reduced. Also, as more downward force can be applied, the user can run or walk more rapidly and thus the exercise can be conducted at a higher rate of intensity.

The foregoing and additional objects, features and advantages of the invention will become apparent to those who are skilled in the art from the following detailed description of a preferred embodiment, taken with the accompanying drawings, wherein like reference numerals in the various drawings identify like components.

BRIEF DESCRIPTION OF THE DRAWINGS

FIG. 4 illustrates a side view of the preferred embodiment of the upper hinge with the friction control nut.

FIG. 5 illustrates a cross-section of the preferred embodiment of the upper hinge.

FIGS. 6A and 6B show in cross-section the preferred embodiment of the lower pole tip.

FIGS. 7A–7D are perspective illustrations of a grip member with upper and lower locking nuts.

DESCRIPTION OF THE PREFERRED EMBODIMENT

Figure 1:
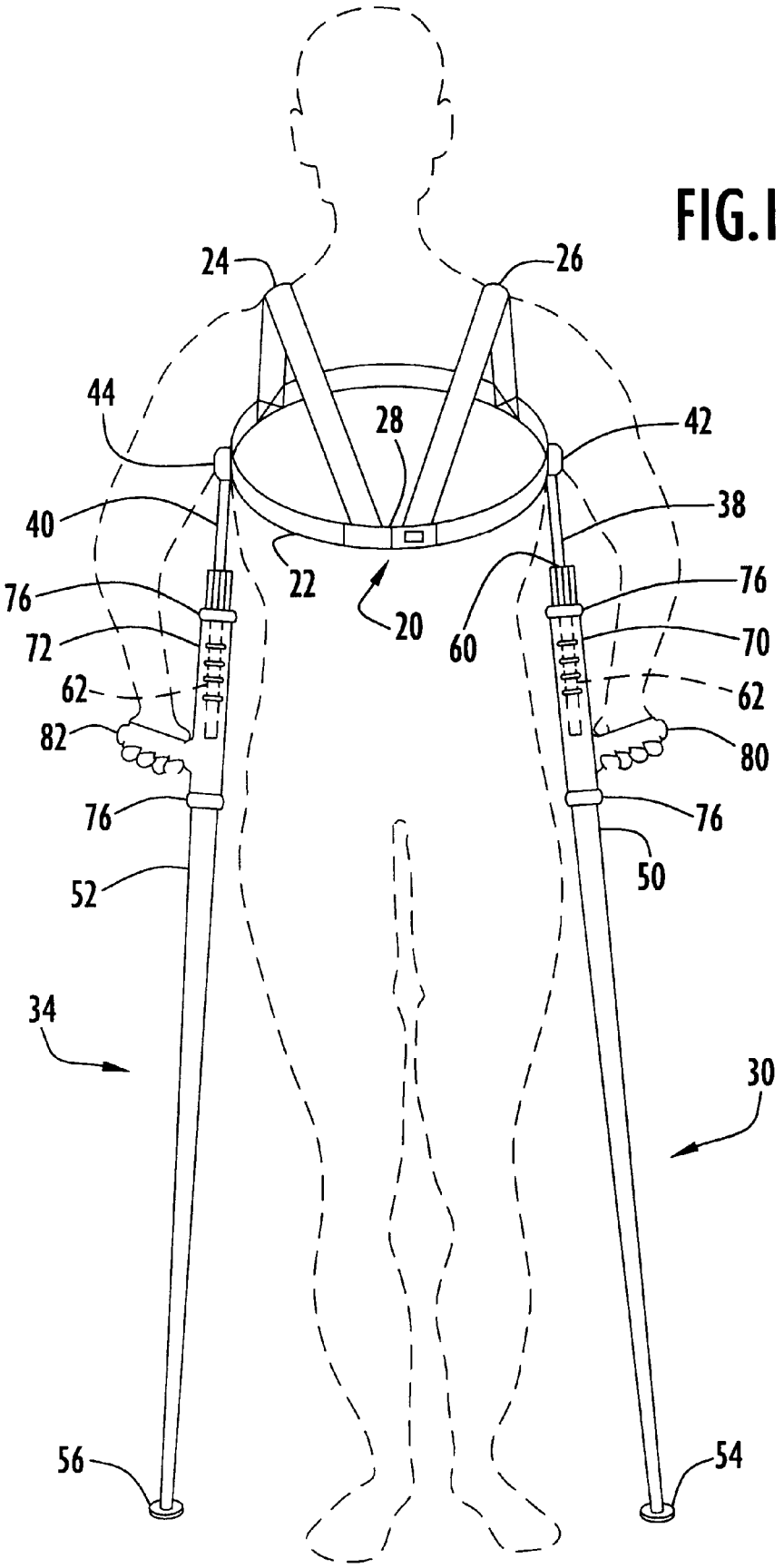
FIG. 1 illustrates, in perspective, the exercise apparatus of the present invention, as viewed from the front of the user.

The exercise device according to the present invention is illustrated in FIG. 1. Harness 20 is placed over the shoulders of the user. A horizontal strap 22 is preferably nylon webbing or leather and is connected with first and second vertical straps 24, 26 over the shoulders. The horizontal strap 22 is joined by a buckle or resiliently releasable latching clasp 28; the buckle or clasp 28 also includes provisions for attachment of the vertical straps 24, 26. Left and right exercise poles 30, 34 each include an elongate upper segment rod 38, 40 having a circular cross-section of a first diameter and being joined to the horizontal strap via a joint 42, 44. Joints 42, 44 allow a selected amount of front to back movement. Elongate tubular lower segments 50, 52 have are slid over the upper segments 38, 40. Each lower segment 50, 52 is circular in cross section, has a second inside diameter which is slightly larger than the upper segment first outside diameter and is terminated at a distal end in a pole tip 54, 56. Using the left pole 30 as an example, the distance from the joint 42 to the proximal end 60 of lower segment 50 is preferably be in the range of six to eight inches when the user's feet and the pole tip 54 are placed on the ground; the upper segment 38 extends ten inches into the lower segment 50 as illustrated by the inserted part of the upper segment 62. Typically, the upper segment 38, 40 reaches the same level as the user's posterior. Grip members 70, 72 are fitted over the lower segments 50, 52 and can be adjusted for vertical position and radial orientation by loosening threaded collet nuts 76 and then retightening them when a satisfactory position is located. The grip members 70, 72 each have a roughly horizontal hand hold 80, 82 to be held when the exercise apparatus of the present invention is used in accordance with the method of the present invention.

Figure 2:
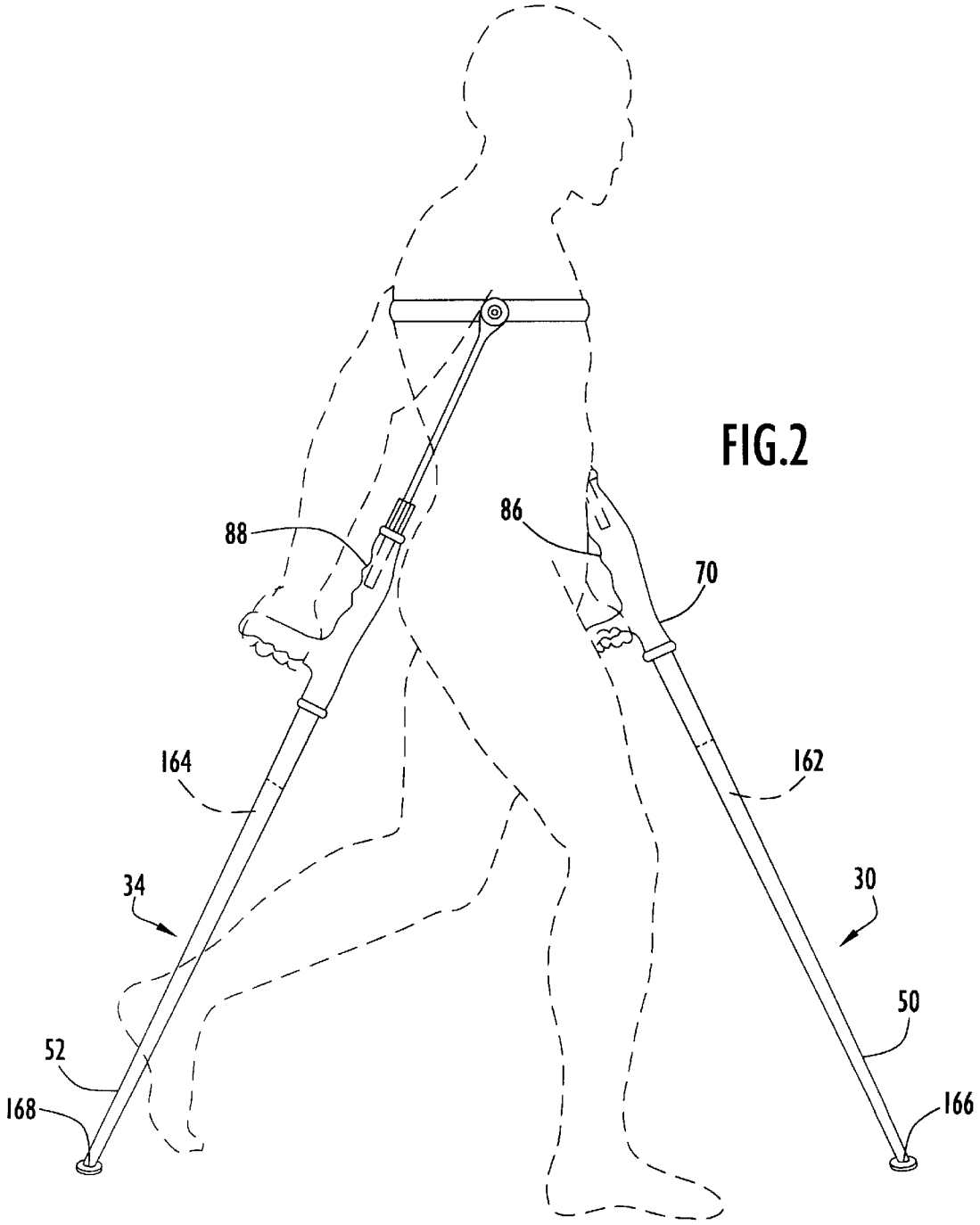
FIG. 2 illustrates, in perspective, a side view of the apparatus of the present invention.

Alternatively, the lower segments 50, 52 can be separated from the upper segments 38, 40 for a less strenuous workout by using the lower segments 50, 52 in a manner similar to the use of cross country ski poles while trekking or skiing. Each grip member 70, 72 includes a vertical grip 86, 88 for this purpose, as shown in FIG. 2.

In the preferred embodiment, the lower segments 50, 52 are extruded and tapered aluminum tubing and the upper segment rods 38, 40 are extruded low friction plastic (e.g., molybdenum disulfide filled Nylon™) tubes. Collet nuts 76 are molded from nylon and the grip members 70, 72 are molded in two halves from type 6 nylon. Harness 20 is preferably made from nylon webbing strap. In an alternative embodiment, the harness 22 is incorporated into a vest or shirt which the wearer simply dons with the joints 218, 220 attached. The vest embodiment is described in further detail below.

The upper segments 38, 40 are slidably, telescopically held within the lower segments 50, 52, and the lower segments may be slidably moved proximally or distally. The lower segments 50, 52 are also rotatable (using the horizontal hand holds 80, 82) about the common, central longitudinal axis of the lower and upper segments. In the illustrated embodiment, the central longitudinal axes of the upper and lower segment (e.g., 38, 50) of the exercise pole 30 are coaxial; however, the only operational requirement is that the upper and lower segments have parallel axes.

Figure 3:
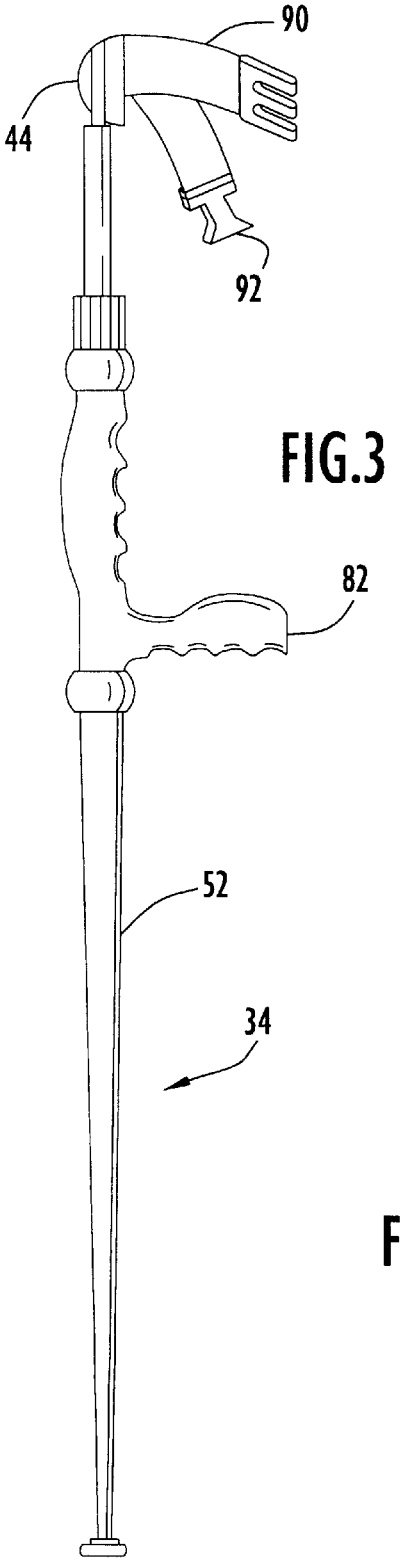
FIG. 3 illustrates a perspective view of an exercise pole with an arm-band harness.

In an alternative embodiment as illustrated in FIG. 3, joint 44 is affixed to an arm-band harness 90 which is detachably attachable with a fastening 92 to a user's upper arm. The arm band is tightly wrapped around the user's upper arm so that, by extending the elbow, the horizontal hand hold 82 is distally displaced from the joint 44 as the lower segment 52 slides along the inserted upper segment 40.

Joints 42, 44 may be a hinge, a coil spring, or a rod section made from an elastomeric material. The joints 42, 44 must permit the upper segments 38, 40 to swing in a front to back arc of approximately 60 degrees.

Turning now to FIG. 4, in the preferred embodiment, the joint (e.g., 42) is a hinge and is shown at the proximal end of upper segment 38. FIG. 5 shows a cross-section, taken along line A—A in FIG. 4, of the hinge 42 and upper segment 38. A molded plastic, preferably nylon, shoulder bushing 94 incorporates a wide flange 96 with a rounded profile for contact with the user's body. The other side of flange 96 incorporates raised prongs which engage the webbing strap 22. Flange 96 also incorporates a tubular hub or axle section 100. A rounded annular proximal end of upper segment 38 includes a through bore 102; axle 100 is within bore 102. A threaded section 104 is fabricated onto the exterior of axle 100, proximate to the axle distal end. The axle has a full length key way 110 integrally molded therein. Washers 112, 114 include a key which engages the key way 110, thereby keeping the washers 112, 114 from rotating. Washers 112, 114 are captively retained on both sides of the upper segment proximal annular end, as illustrated in FIG. 5. A threaded outer nut 120 holds joint 42 together. Washers 112, 114 prevent the rotational force of the upper segment 38 from being transferred to the outer nut 120. Threaded outer nut 120 also allows a selected amount of friction to be generated through tightening of the nut down on the threaded section 104 of axle 100, thus allowing a user to adjust the effort required to move the exercise pole in a fore and aft movement.

Figures 7B, 7C:
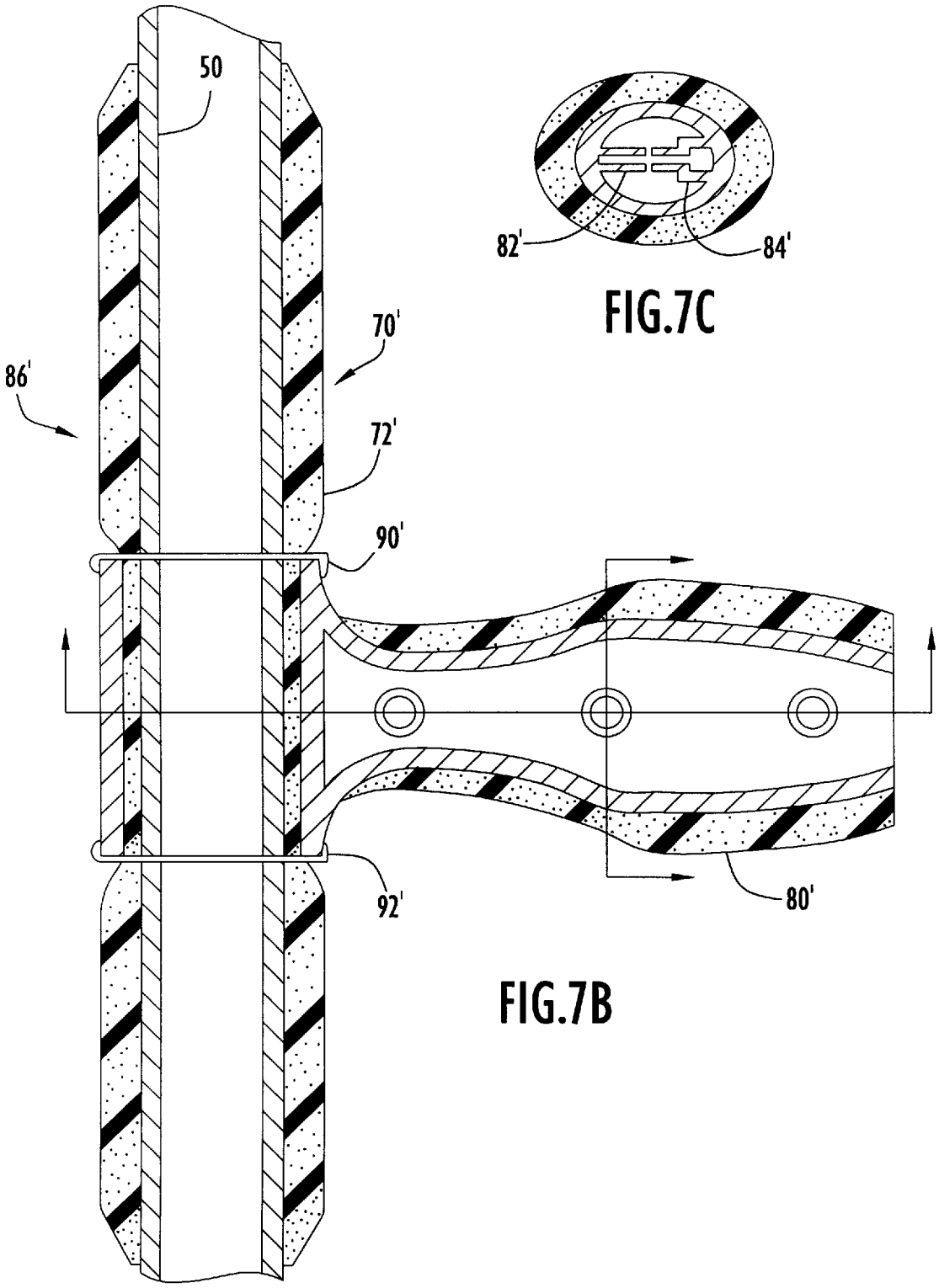
Figure 7D:
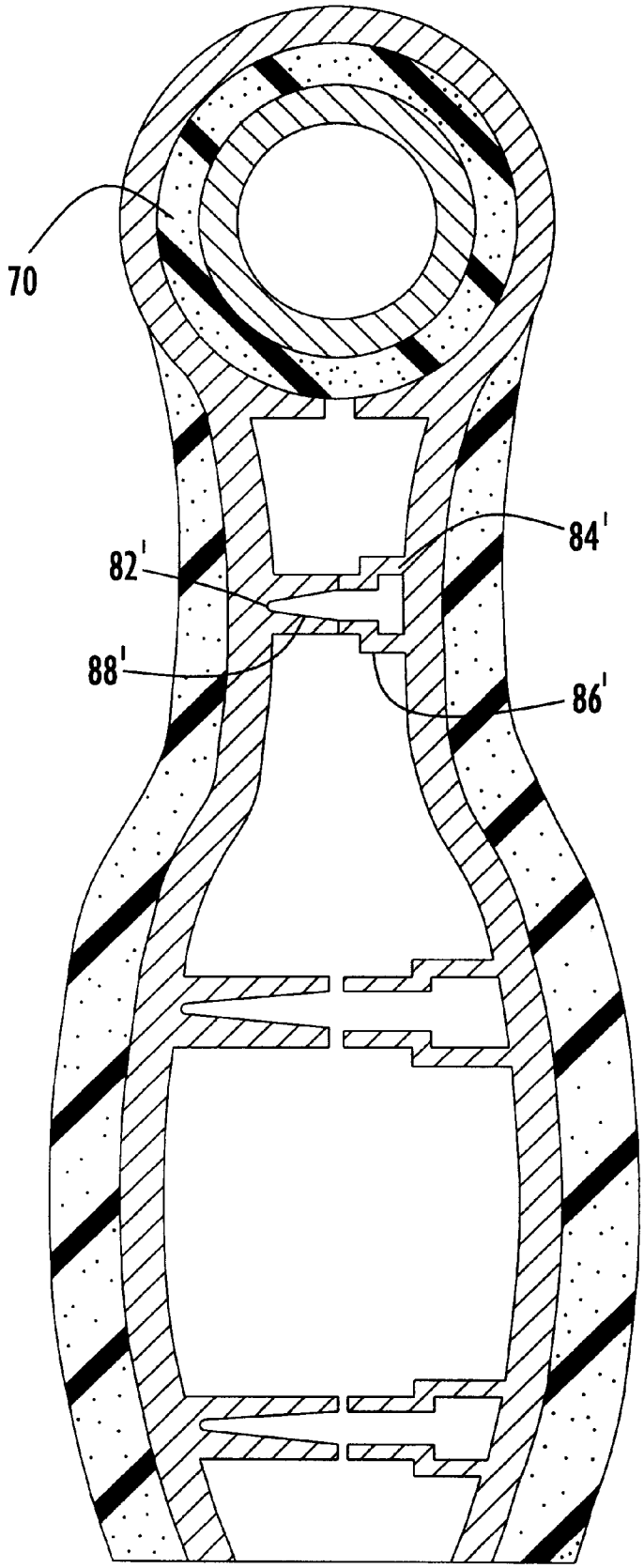

FIG. 7A shows grip member (e.g., 70) which is typically composed of two molded mirror image halves 130, 132. The mirror imaged halves 130, 132 are held together by upper and lower threaded collet nuts 76*a*, 76*b* which are threadably attachable to upper and lower collet ends 131*a*, 131*b*. The collet ends are notched in two transverse planes which are angularly displaced by ninety degrees thus forming four collet fingers on each collet end. As the collet nut 76 is tightened on the collet end, the collet fingers of the collet end are displaced inwardly to apply frictional force to the lower segment exterior surface, thus fixing the position of the grip member 70 on the lower segment 50. The upper collet nut 76*a* is located at the top of grip member 70 and a lower collet nut 76*b* is (optionally) located at the bottom of the grip member 70. These nuts preferably have a knurled external gripping surface and allow the hand grip to be vertically positioned (higher or lower) and radially oriented (rotated about the lower segment longitudinal axis) on the exercise pole. The grip member (e.g., 70) is preferably covered with a thin layer of open cell foam, to cushion the gripping surfaces and improve a user's ability to grasp the grip member with wet hands. The foam is preferably that type of resin or plastic foam customarily used on bicycle or exercise equipment handlebars.

Figure 8:
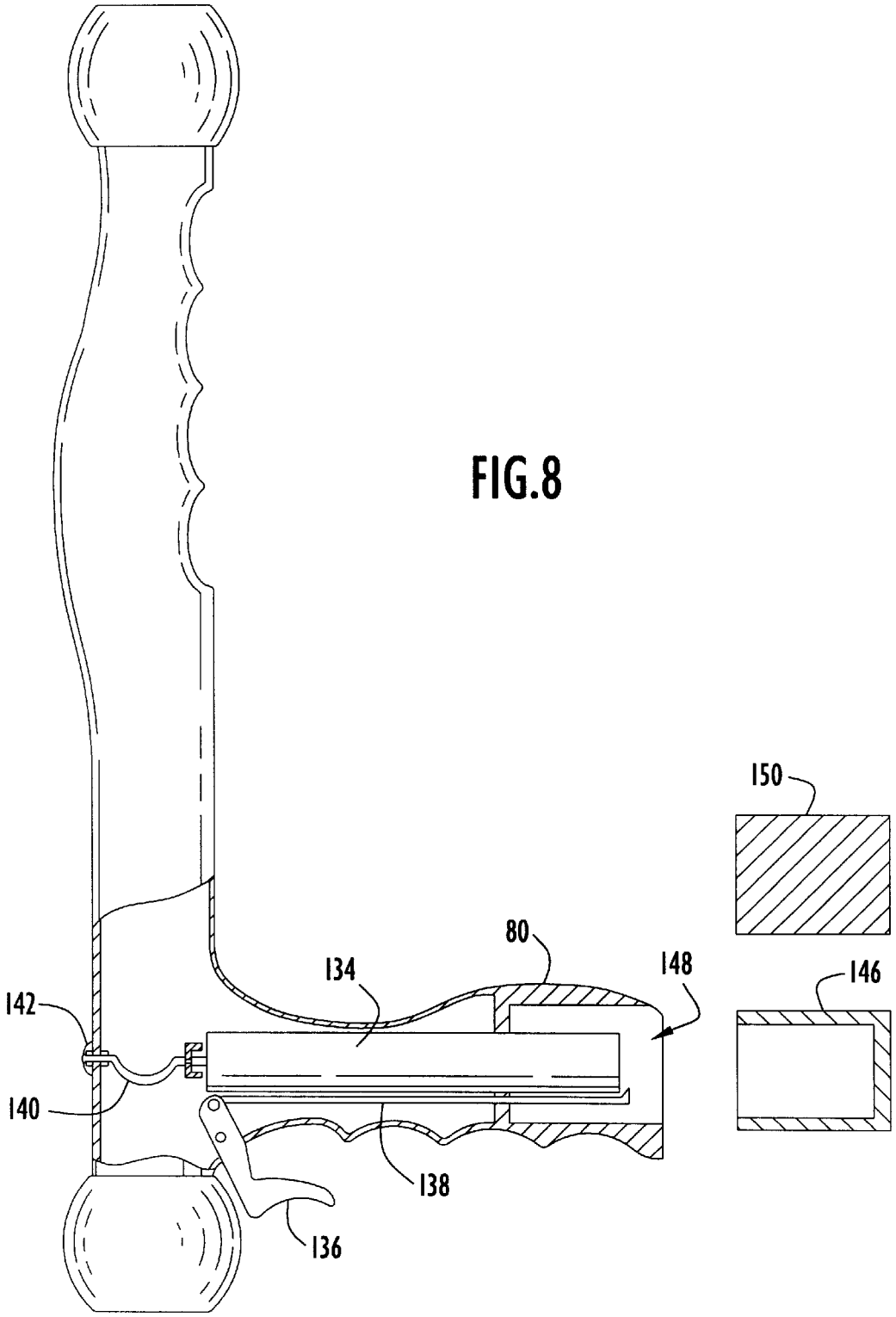
FIG. 8 illustrates a cross-section of the two position hand grip with the storage location for the chemical spray and the trip spray control trigger.

Turning now to FIG. 8, in an alternative embodiment, the end of the horizontal hand hold (e.g., 80) is hollow and is adapted to retain a canister of chemical defensive spray 134. A spray trigger 136 activates the spray through a linkage 138 causing the spray to travel through a tube 140 and a nozzle 142 toward a point of aim. A protective end cap 146 is used to cover the rearwardly facing opening 148 in horizontal hand hold 80. In normal use, the horizontal hand hold 80 will face generally rearwardly and the nozzle 142 will face forward. In an alternative embodiment, a solid weight 150 is substituted for the protective spray and end cap in opening 148.

In another alternative embodiment, more weight can be added to the exercise poles 30, 34 by pouring water into lower segments 50, 52; the tubular lower segments ends must be sealed to retain the water.

The lower segments 50, 52 may be slidably removed from the upper segments. Grip member 70 also includes a vertical grip 86 for use when the lower segment 16 is used as a trekking pole.

Figure 6B:
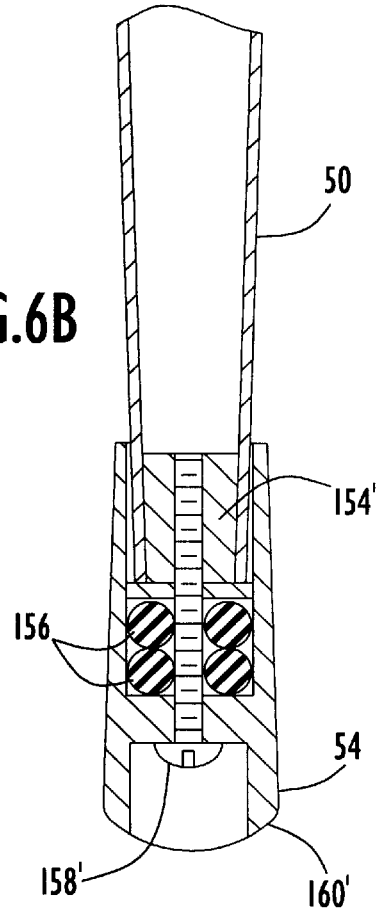

FIGS. 6A and 6B show the preferred embodiment for a pole tip (e.g., 54) mounted upon the distal end of the lower segment 50. The tip 54 includes an upper bushing 154 which retains a spring 156. The distal end of spring 156 engages a lower bushing 158 which is be movable over upper bushing 154; preferably, a force of approximately fifty pounds is required to completely compress spring 156. In the preferred embodiment, a medium durometer (about 70–80) elastomer, preferably rubber, cover 160 is molded over lower bushing 158, thereby providing additional impact resistance. Preferably, lower bushing 158 has a great enough diameter (e.g., 0.5–1.0 inch) to prevent the tip from becoming stuck in a sidewalk crack or in soft ground.

Figure 10:
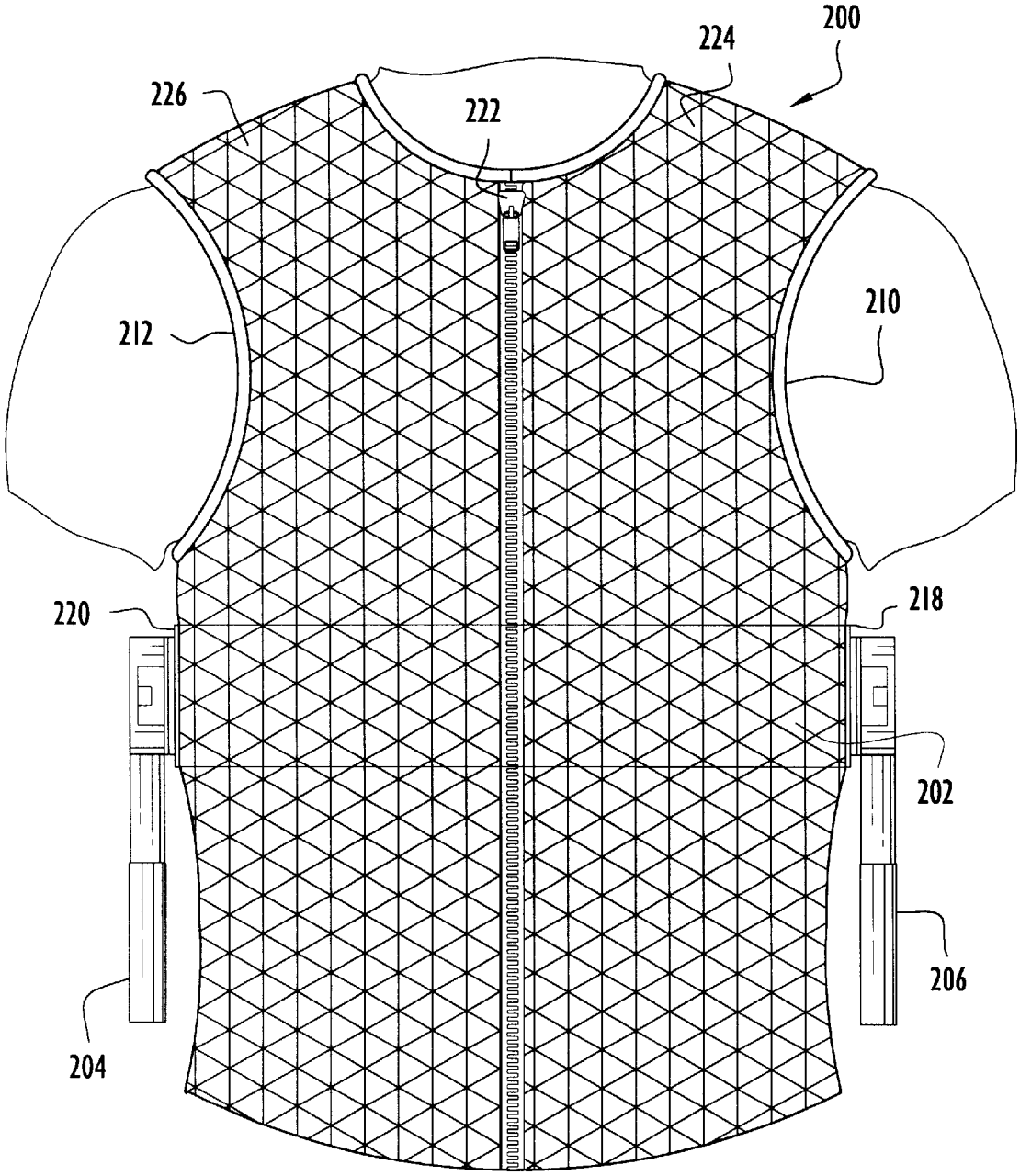
FIG. 10 illustrates, in perspective, the exercise apparatus vest and integral harness of the present invention, as viewed from the front of the user.
Figure 11:
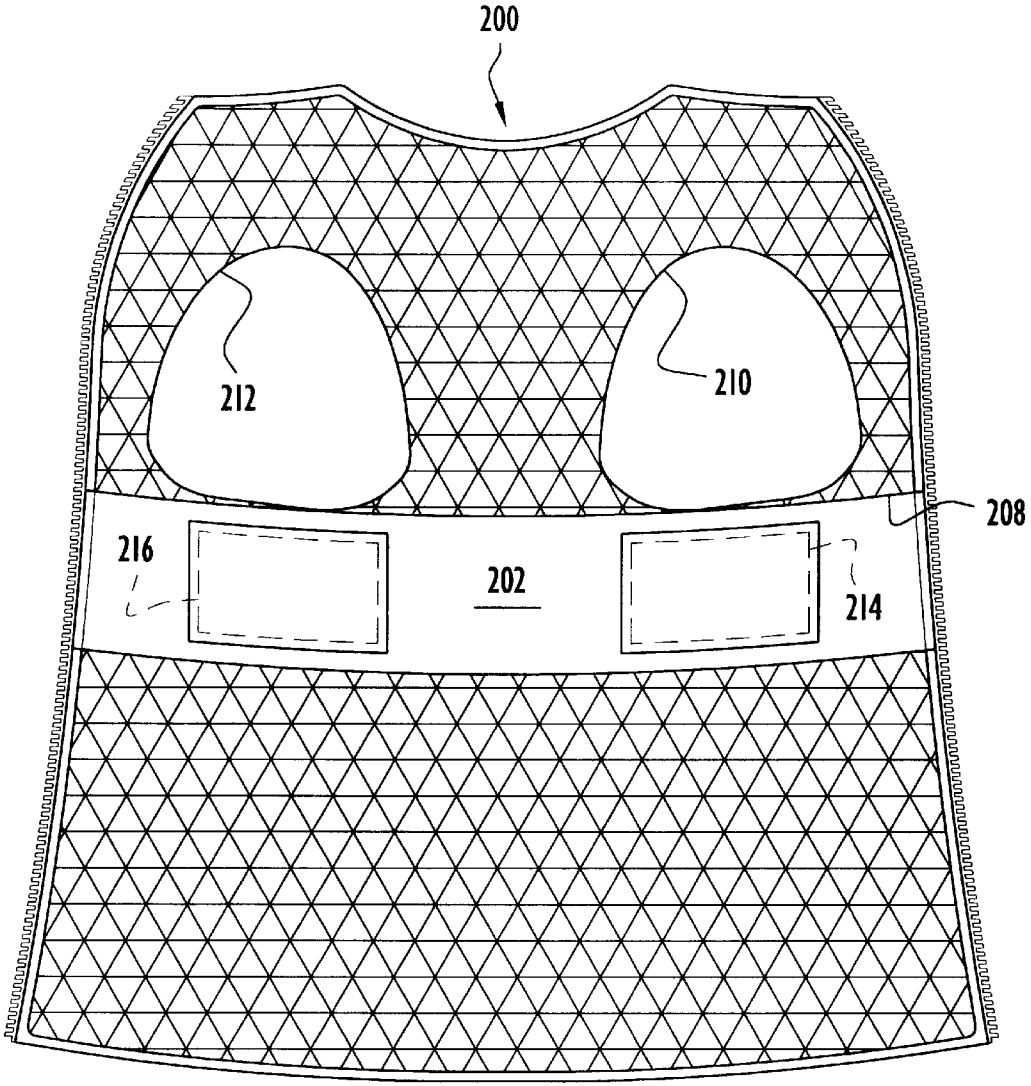
FIG. 11 illustrates the interior of the opened vest of FIG. 10.

FIG. 10 illustrates, in perspective, an alternative embodiment of the exercise poles having a vest 200 and integral harness webbing 202, as viewed from the front of the user. FIG. 11 illustrates the interior of the opened vest of FIG. 10 showing the harness webbing 202. The upper segments 204, 206 are hingedly connected to vest 200 and integral elastic webbing harness webbing 202 with a horizontal strap 208 running underneath left and right vest arm holes, 210, 212, across the vest back and connecting in first and second stitched connections 214, 216 in the molded hub bases 218, 220 which are disposed on the vest exterior (as shown in FIG. 10). The vest is fastened over the chest (and preferably covers the abdomen) with one or more releasable fasteners such as snaps, buttons, hooks/loops or a heavy duty (e.g., YKK™ brand) zipper 222 (shown closed in FIG. 10) and includes first and second vertical shoulder straps 224, 226 running over the shoulders and down the back to the horizontal strap 208.

Figure 15:
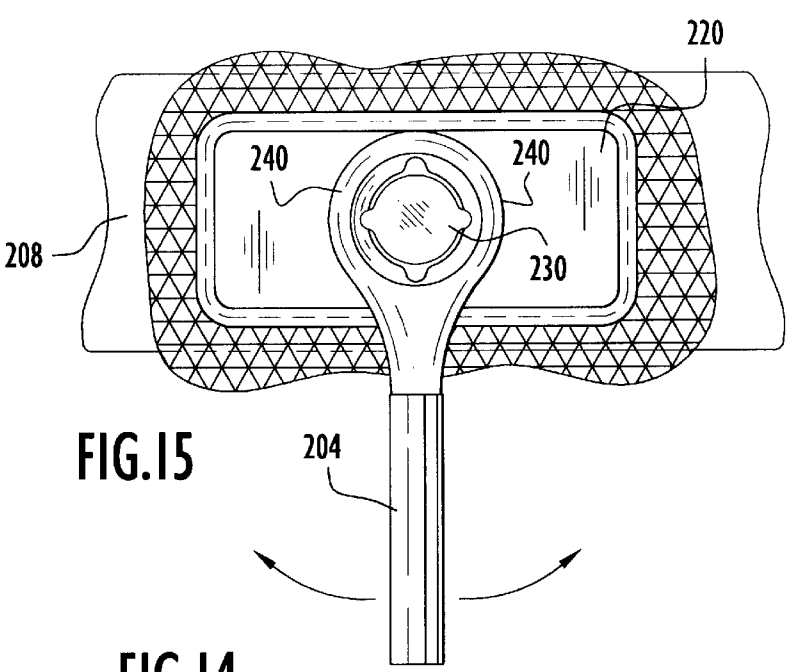
FIG. 15 is a top view of the hinge hub FIG. 14 and shows the collar flange grooves mis-aligned with hub bayonet lugs.
Figure 14:
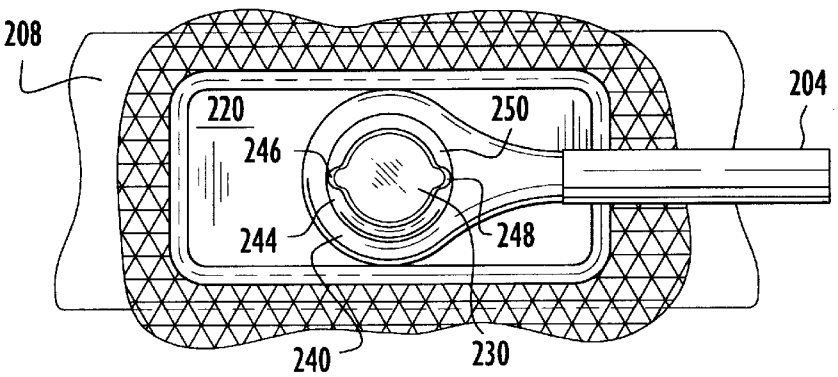
FIG. 14 is a top view of the hinge of the vest of FIG. 10.
Figure 13:
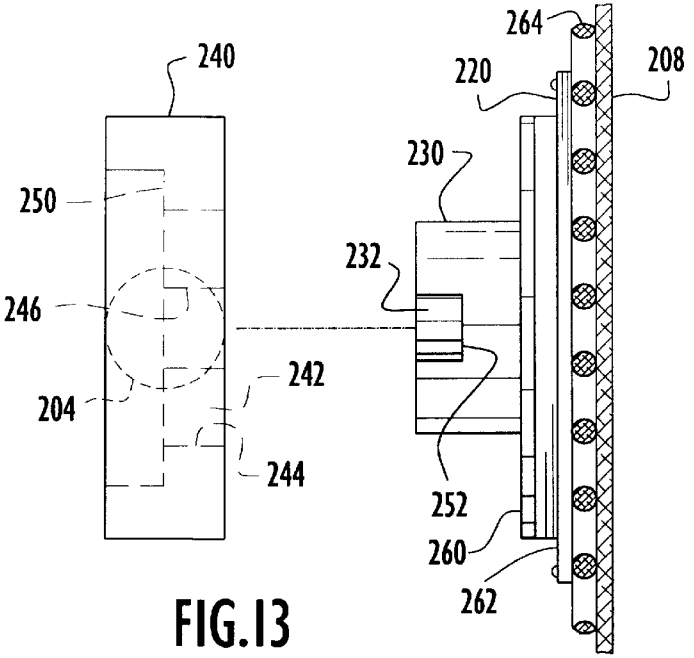
FIG. 13 is an exploded side view of a hinge including the hub of FIG. 12.
Figure 12:
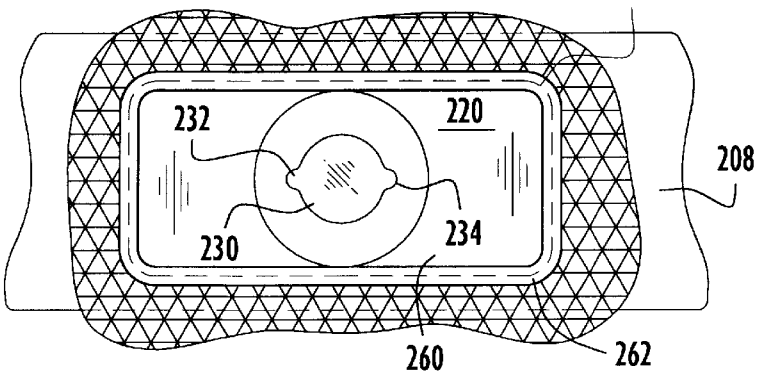
FIG. 12 is a top view of the hinge hub of the vest of FIG. 10.

FIG. 12 is a top view of hinge hub 230 on vest 200 and FIG. 13 is an exploded side view of a hinge including the hub 230 of FIG. 12. Hinge hub 230 projects transversely from and is integrally molded in a one-piece structure with the substantially planar hub base 220 (fastened in stitched connection 216). Hinge hub 230 is part of a mechanical joint comprised of cylindrical molded hub 230 with, preferably, two opposed transversely projecting bayonet lugs 232, 234. As shown in FIGS. 13 and 14, the joint hub 230 can be received within a collar 240 affixed at the proximal end of upper segment 204 and has a circular aperture 242 ringed by an inwardly projecting annular flange 244 with two opposed grooves 246, 248 adapted to receive two hub bayonet lugs 232, 234. Hub 230 and collar 240 are separable (as shown in FIG. 13) and are joined (as shown in FIG. 14) by aligning the hub bayonet lugs 232, 234 with the collar flange grooves 246, 248, whereupon the hub may be inserted coaxially within the collar, thereby projecting the hub lugs 232, 234 beyond the opposing (outward) surface 250 of the inwardly projecting annular flange 244. Collar 240 (and attached upper segment 204) may then be rotated (as shown in FIG. 15) around the axis of hub 230 to rotatably secure collar 240 onto hub 230. Selected amounts of static friction and sliding friction between the each lug's inner surface 252 and the corresponding flange opposing surface 250 control the effort required in exercising, while swinging the exercise poles in a fore and aft motion. The hub 230 (and integral base 220) and the collar 240 are made of plastic such as nylon, ABS, or another resilient material.

The vest 200 and integral harness are efficiently manufactured (see, e.g., FIGS. 10, 11, 12 and 13) by first molding first and second one-piece hub and substantially planar base assemblies (e.g., such as 230, 220) including a thicker central platform portion 260 (at least partially) surrounded by a thinner flange 262 adapted to be sewn through. Each integral hub/base assembly is positioned on a vest fabric wall 264 approximately under the vest arm holes (as described above) preferably with an elastic harness webbing or strap 208 on the opposing side of the vest fabric wall, and the base/vest/harness laminated structure is sewn through (or other wise affixed) in making a stitched connection (e.g., 216). Alternatively, the vest fabric wall material may be semi-elastic, allowing hinge hubs (e.g., 230) to be sewn onto the vest fabric wall, preferably opposite a reinforcing patch.

In use, the user attaches the upper pole segments 204, 206 to the hubs (e.g., 230), dons and closes (e.g., zips) the vest 200 and grasps the horizontal hand holds on each pole.

Figure 9:
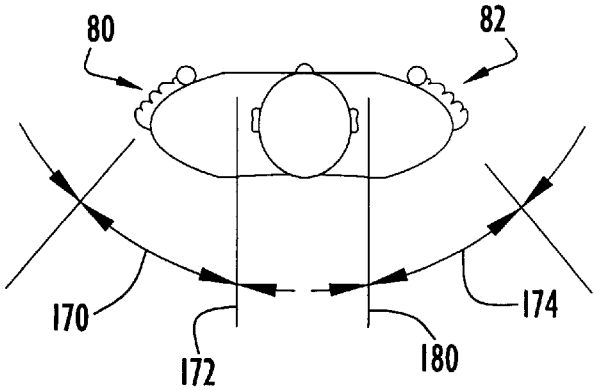
FIG. 9 illustrates a view from above of the user gripping the hand holds.

In practicing the method of the present invention, a user dons the harness 20 and grasps the horizontal hand holds 80, 82 on each pole 30, 34. Horizontal hand holds 80, 82 may be rotated about the central longitudinal axis of the exercise poles 30, 34 to a natural position. As illustrated in FIG. 9, the left hand hold 80 normally points to an eight o'clock position; this corresponds to an outward angle 170 of about 30–60 degrees from an imaginary line 172 pointing to the rear. The right hand hold 82 normally points to a four o'clock position; this corresponds to an outward angle 174 of about 30–60 degrees from a second imaginary line 180 pointing to the rear. The preferred hand orientations correspond to the angular orientation the hands assume when standing with the arms hanging down at rest. For purposes of nomenclature, these hand orientations are defined as the natural grasping position.

As the user begins running or walking, a pole lower segment (e.g., 50) is swung forward and extended distally down to plant the pole tip 54 and engage the ground. Force is then applied downwardly on the hand hold 80 via the hand, arm and upper body muscles to allow the user to exercise these muscles and lessen the shock and load on the legs. The user then strides past the planted pole 30. Once the user has stridden past the planted pole 30, the pole lower segment 50 is lifted in a rectilinear proximal contraction along the upper segment axis by contracting the elbow and is arcuately swung forward and the cycle is repeated.

When a user's legs are separated by the maximum length of stride, the poles 30, 34 will be as close to each other as possible. As illustrated in FIG. 2, when the right foot is down and in the forward position, the left pole is at the forward most angle and is soon to be planted. The sequence is, then, swinging the left exercise pole 30 forward while extending the left arm and hand, thereby slidably moving the left hand hold 80 distally away from the hinge 42 and slightly twisting or rotating the hand hold; planting the tip 54 of the left exercise pole on the ground at a first point on the ground; placing at least some of the user's weight on the left hand hold 80; then swinging the right exercise pole 34 forward while extending the right arm and hand, thereby slidably moving the right hand hold 82 distally away from the hinge 44 and slightly twisting or rotating the hand hold 82; planting the tip 56 of the right exercise pole on the ground at a second point on the ground; and placing at least some of the user's weight on the right hand hold, and so forth. In the method of the present invention, the user grasps the hand holds 80, 82 in his or her own natural grasping position and, while swinging the poles forward, may allow the wrists and hands to twist or rotate the hand holds 80, 82, in the natural motion which accompanies swinging of the arms.

Alternative methods of use are also possible with the apparatus of the present invention. It may be desirable to use a single pole as a balancing aid or to reduce risk of injury on only one side. It may also be useful to use two exercise poles as balance aids in especially treacherous terrain.

In alternative embodiments, the exercise poles 30, 34 can be marked with high visibility reflective tape for safety on the road and may be used as supports for flashing lights or the like. A drinking water dispenser may be incorporated into the lower segment water storage area. The harness 20 or arm band harness 90 may be fastened with any releasable fastener equivalent in function to buckle or clasp 28 such as a snap fastener, a button or a hook-and-loop type fastening.

The foregoing describes the preferred embodiments of the present invention along with a number of possible alternatives. A person of ordinary skill in the art will recognize that modifications to the described embodiments may be made without departing from the true spirit and scope of the invention. The invention is, therefore, not restricted to the embodiments disclosed above but is defined in the following claims.

I claim:

1. An exercise apparatus, attached to a user's body and manually grasped by the user, for use while running or walking, comprising;

a vest including a releasable fastener and first and second shoulder straps, for attachment to the user's body;

a first elongate upper segment having a proximal end and a distal end, wherein said proximal end is hingedly affixed to said vest;

a first elongate lower segment having a first horizontal hand hold fitted thereon, a proximal end and a distal end with a pole tip affixed thereupon, said proximal end being slidably and rotatably engaged with said first elongate upper segment distal end with said first horizontal hand hold disposed beneath said first upper segment distal end;

a second elongate upper segment having a proximal end and a distal end, wherein said proximal end is hingedly affixed to said vest;

a second elongate lower segment having a second horizontal hand hold fitted thereon, a proximal end and a distal end with a pole tip affixed thereupon, said proximal end being slidably and rotatably engaged with said second elongate upper segment distal end with said second horizontal hand hold disposed beneath said first upper segment distal end.

2. The exercise apparatus of claim 1, wherein said first vest releasable fastener is a zipper.

3. The exercise apparatus of claim 1, wherein said first and second upper segments are rods of circular cross-section having a first outside diameter and having a central axis;

wherein said first and second lower segments are tubes of circular cross section having a second inside diameter larger than said first outside diameter;

wherein said first upper segment is slidably inserted coaxially into said first lower segment tube; and wherein said second upper segment is slidably inserted coaxially into said second lower segment tube.

4. The exercise apparatus of claim 1, wherein said first lower segment is at least partially filled with water.

* * * * *